United States Patent [19]

O'Brien et al.

[11] 4,035,116

[45] July 12, 1977

[54] PROCESS AND APPARATUS FOR FORMING ESSENTIALLY SPHERICAL PELLETS DIRECTLY FROM A MELT

[75] Inventors: John L. O'Brien, Winchester; Robert R. Perron, Beverly; Peter F. Strong, Harvard, all of Mass.

[73] Assignee: Arthur D. Little, Inc., Cambridge, Mass.

[21] Appl. No.: 722,008

[22] Filed: Sept. 10, 1976

[51] Int. Cl.[2] ..... B22D 23/08; B22F 9/00

[52] U.S. Cl. ..... 425/10; 264/5; 264/13; 425/145; 425/144; 425/135; 425/6

[58] Field of Search ..... 425/6, 10, 135, 145, 425/144; 264/5, 13

[56] References Cited

U.S. PATENT DOCUMENTS

| | | | |
|---|---|---|---|
| 1,393,383 | 10/1921 | Linebarger | 425/6 X |
| 3,123,855 | 3/1964 | Fischer et al. | 425/6 |
| 3,231,641 | 1/1966 | Edmunds | 425/6 X |
| 3,325,858 | 6/1967 | Ogden et al. | 425/6 |
| 3,744,983 | 7/1973 | Jenkins | 425/6 X |

*Primary Examiner*—Robert L. Spicer, Jr.
*Attorney, Agent, or Firm*—Bessie A. Lepper

[57] ABSTRACT

Process and apparatus for forming essentially spherical solid pellets directly from a melt, and particularly solid metal pellets such as iron and lead. The melt from a column of a preset height is directed through one or more orifices in a way to form a jet which experiences an upwardly directed trajectory path and which under the influence of vibratory action breaks up to form pellets of a predetermined diameter. Adjustments of the column height and/or vibration frequency are used to control pellet diameter. The pellets may be formed and solidified in a controlled atmosphere; and in the case of iron pellets, the carbon content of the pellets may be adjusted, to attain a desired degree of hardness, either before or after pellet formation. Iron pellets thus formed are particularly suitable as substitutes for lead pellets in ammunition.

36 Claims, 7 Drawing Figures

Fig. 3
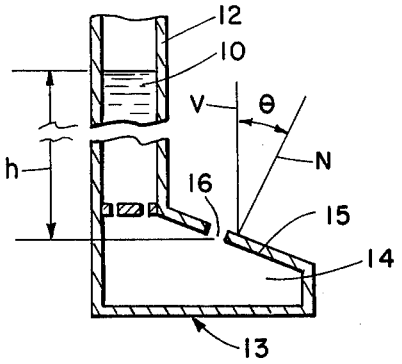
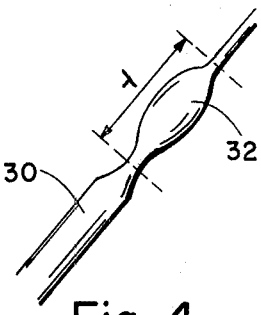
Fig. 4
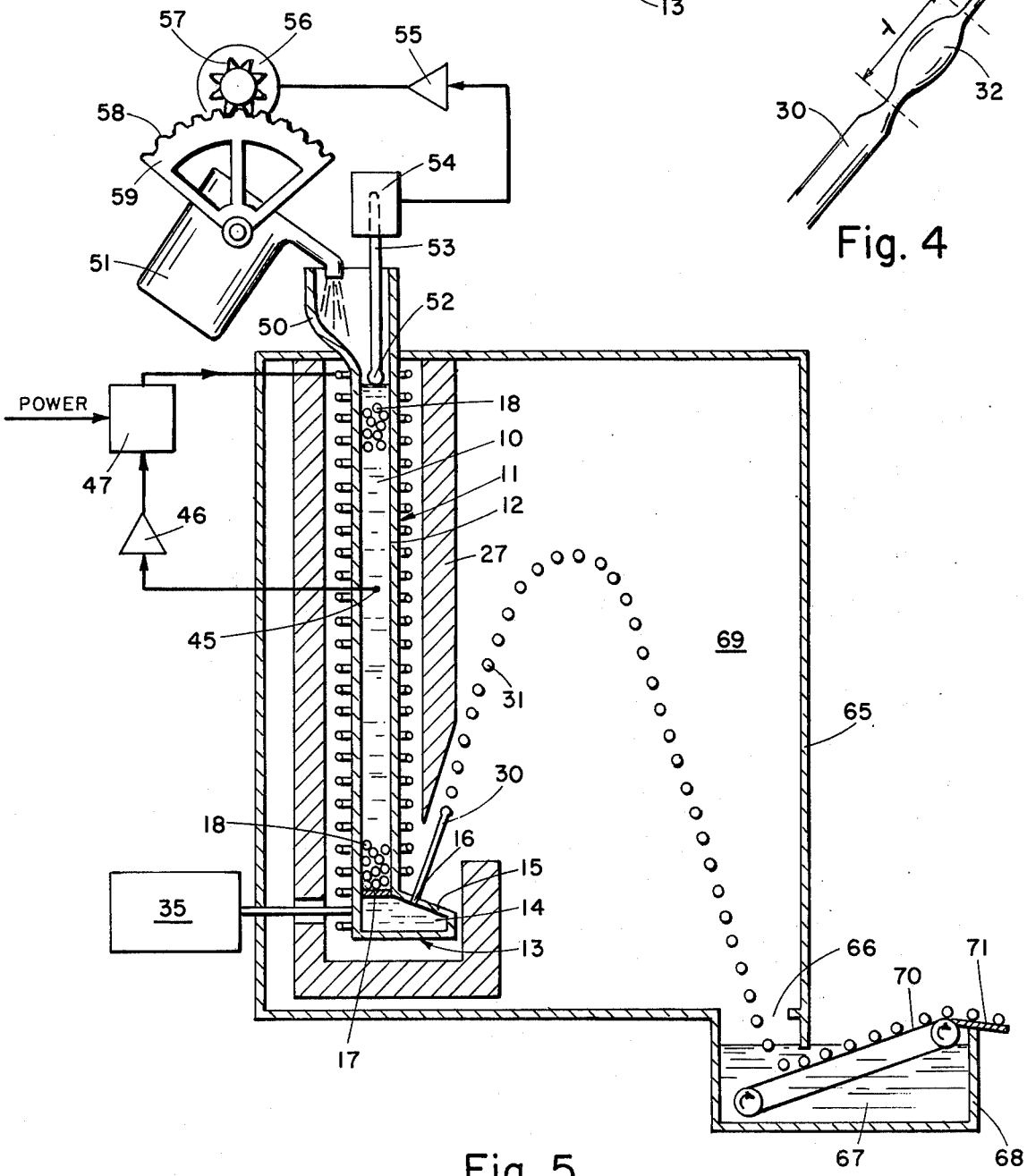
Fig. 5

PROCESS AND APPARATUS FOR FORMING ESSENTIALLY SPHERICAL PELLETS DIRECTLY FROM A MELT

This invention relates to a process and apparatus for forming essentially spherical pellets directly from a melt, and more particularly to forming spherical pellets of such metals as iron or steel, lead, copper and the like.

Lead shperical pellets have been used for a number of years in shotgun shells. However, the Fish and Wildlife Services of the U.S. Department of the Interior has now established that waterfowl die by lead poisoning from shotgun pellets ingested when feeding on the bottom of marshes and lakes. To reduce this problem, the Fish and Wildlife Service has proposed the use of iron shot as a substitute for lead since it does not present toxicity problems.

Although the process and apparatus of this invention are applicable to forming solid spherical pellets from any material which exists in a stable melt form and has a relatively sharp well-defined melting point, they are especially suitable for forming metal pellets. For convenience in describing this invention, the formation of iron pellets will be used as exemplary. The term "iron" is used herein in a broad sense and is meant to include those alloys of iron (e.g., steel) which contain an appreciable quantity of iron. Moreover, this invention will be described, for convenience, in terms of forming iron pellets for shotgun shells; although it is, of course, obvious that iron pellets and pellets formed of other metals can have many other uses.

There are available in the prior art, several processes from forming spherical metal pellets. For example, lead is normally formed into spheres by dropping the molten metal through holes of predetermined diameters in a shower pan placed high in a shot tower. The spheres are cooled in dropping down through the tower and solidification is completed when they enter water contained in the base of the tower. This process for forming lead spheres is both cheap and relatively efficient. Although iron pellets can be formed by essentially the same technique, the most common technique for forming iron shot uses iron wire and involves the pinching off of lengths of the wire and then heading it into spherical particles. Iron shot made by this technique is expensive compared to the cost of making lead shot; and because it is harder than lead, it must be treated (i.e., decarburized) to make it useable in a shotgun barrel without causing undue scoring of the barrel surface.

Thus it is apparent that there is a particularly urgent need for an improved precess and apparatus for forming iron shot, and also a need for forming iron shot which is sufficiently soft to permit it to be used in shotgun shells.

It is therefore a primary object of this invention to provide an improved process for forming solid, essentially spherical directly from a melt. It is another object to provide a process of the character described which produces pellets of essentially spherical configuration having relatively small variance in diameter. Still another object is to provide a process which makes possible the manufacture of iron shot at a cost to make it competitive with lead shot. An additional object is to provide a process of the character described which may incorporate one or more steps directed to decreasing the hardness of at least the surface of the iron shot to the extent that its use in ammunition would not have a deleterious effect on the barrels of the guns in which the ammunition is used.

Another primary object of this invention is to provide apparatus for the making of essentially spherical solid pellets directly from a melt. It is another object to provide apparatus of the character described which requires a relative low capital investment and results in production of iron pellets at a cost to make them competitive with lead pellets in ammunition. Still another object is the providing of apparatus for forming essentially spherical metal pellets which incorporate means for controlling the diameter of the pellets as well as for maintaining the pellets within a predetermined narrow diameter range. A further object is to provide apparatus for making spherical iron pellets, the hardness of at least the outer surface of which is controlled.

Other objects of the invention will in part be obvious and will in part be apparent hereinafter.

According to one aspect of this invention, there is provided a process for forming solid pellets of essentially spherical configuration directly from a melt, which comprises the steps of providing a column of predetermined height of a melt of a material to be formed into solid spherical pellets; continuously maintaining the melt column at the predetermined height; directing the melt through at least one orifice at the bottom of the melt column to form a melt jet having an upwardly directed trajectory while isolating the melt jet from acoustical and hydrodynamic disturbances induced in the maintaining of the predetermined height; and during the forming of the melt jet, imparting a vibratory motion to the bottom of the melt column, whereby the melt jet breaks up to form essentially spherical pellets continuing in the trajectory, the total length of the trajectory being such that at least the outer skins of the pellets are solidified prior to their accumulation at the end of their trajectory travel.

According to another aspect of this invention, there is provided apparatus for forming solid pellets of essentially spherical configuration directly from a melt, comprising in combination a columnar vessel for containing a melt terminating at its lower end in manifold means having an orifice plate slanted such that the normal to the orifice plate forms an accute angle with the vertical; at least one orifice (normally circular) in the orifice plate arranged to impart an upwardly directed trajectory to a jet of the melt directed therethrough from the vessel; means to impart vibratory motion to the lower end of the columnar vessel; means to maintain the height of the melt within the vessel at an essentially constant predetermined level; means to isolate the melt jet from acoustically and hydrodynamically induced disturbances in the vessel; and heating means to maintain the melt at an essentially constant predetermined temperature.

The invention accordingly comprises the several steps and relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

For a fuller understanding of the nature and objects of the invention, reference should be had to the following detailed description taken in connection with the accompanying drawings in which FIG. 1 illustrates one embodiment of the apparatus of this invention partly in cross section and partly diagrammatically;

FIG. 3 is a diagram showing the orientation of the orifice plate relative to the vertical or columnar vessel axis;

FIG. 4 is a diagram illustrating the parameter λ;

FIG. 5 illustrates another embodiment of the apparatus of this invention;

Figure 1:
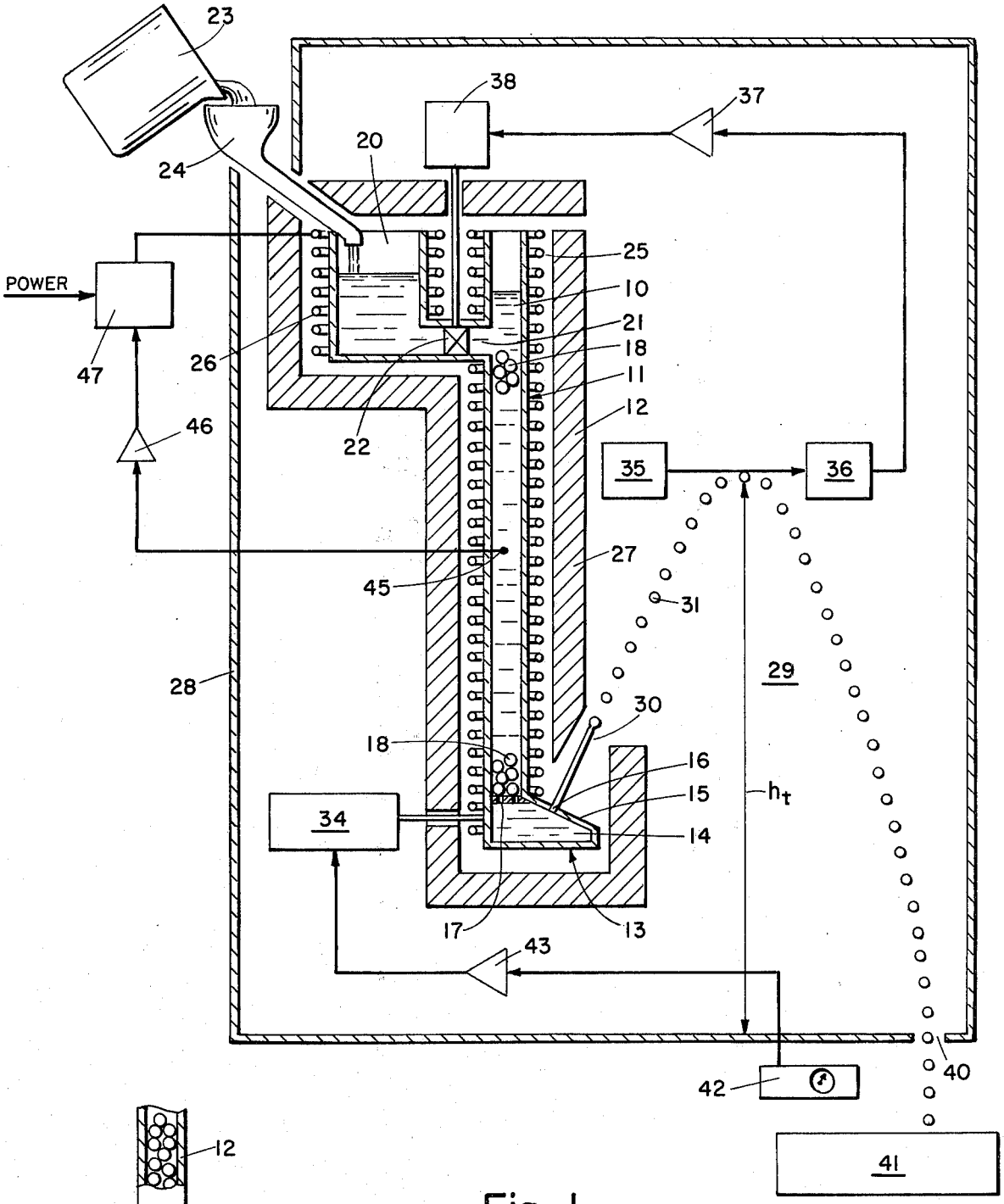
Figure 2:
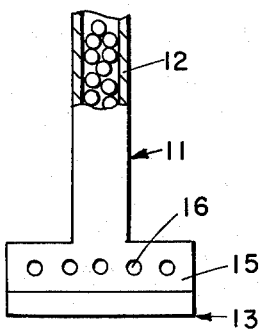
FIG. 2 is a front view of the lower end of the columnar vessel showing a plurality of orifices.

FIG. 1 illustrates one embodiment of the apparatus of this invention as well as the process for forming solid, essentially spherical pellets. The formation of iron pellets of a size suitable for use in shotgun ammunition will be used as illustrative of the process. The iron melt 10 to be formed into solid pellets is contained within a columnar vessel 11 at a predetermined height. Columnar vessel 11 has an elongated column section 12 and it terminates at its bottom in a closed enlarged section 13 which serves as a manifold 14. This manifold has an orifice plate 15 having at least one orifice, and preferably a plurality of orifices 16 (see also FIG. 2). Orifice plate 15 is oriented so that a line N (FIG. 3) drawn normal to the orifice plate makes an acute angle $\theta$ with the vertical V. The angle $\theta$, of course, determines the shape of the trajectory experienced by the melt stream and pellets formed thereof as described below in detail. Within the columnar vessel 11 and at the juncture of the column section 12 and manifold 14, there is placed a foraminous plate 17 (screen or perforated disk) arranged to allow free flow of melt 10 from the column section 12 into the manifold 14, but to prevent the entering of the damping bodies 18 filling column section 12 into manifold 14. These bodies 18 are, for example, spheres, Raschig rings or the like, and their purpose is to provide means for isolating the melt in manifold 14 from acoustic and hydrodynamic disturbances which may be induces in column section 12 in introducing melt into it to continuously maintain the predetermined height of melt in the column.

Connected to columnar vessel 10 is a secondary melt supply vessel 20 joined through a fluid conduit 21. The flow of melt from vessel 20 into vessel 11 is controlled by a valve 22 located in conduit 21. The melt to be used is formed outside the apparatus in suitable equipmemt (not shown) and supplied from a primary melt supply means such as ladle 23 which is used to periodically add melt through funnel 24 into secondary supply vessel 20.

Those components of the apparatus which come into contact with the melt, i.e., the columnar vessel 11, manifold 14, orifice plate 15, foraminous plate 17, damping means 18, secondary vessel 20, conduit 21 and valve 22 must be constructed of a material capable of withstanding the temperature of the melt and of enduring such a temperature over a period of time without experiencing undue erosion. Exemplary of such materials for high-melting point metals are ceramics such as the refractory oxides, e.g., alumina and graphite.

Suitable heating means such as resistance heating wires 25 and 26 are arranged to maintain the melt at a predetermined temperature in the columnar vessel 11 and secondary supply vessel 20, respectively; and thermal insulation 27 is placed around that part of the apparatus wherein the melt is contained. A housing 28 defines within it a chamber 29 in which the apparatus is contained and in which a desired atmosphere may be maintained as described below by circulating, if necessary, one or more gases therethrough using suitable inlet and outlet gas lines.

By forcing melt 10 through orifice 16 under a constant hydrodynamic head, the melt issues from the orifice as a jet 30 which, through the action of the dynamical and surface tension forces, breaks up into spherical pellets 31. By driving the system with a vibratory action near the natural frequency of the system, the volume and hence the diameter of pellets 31 may be accurately controlled. This is accomplished by coupling means to impart vibratory motion to the manifold and to the melt contained therein. The frequencies used are within the acoustic range, e.g., from about 5 Hz to about 50 kHz, and the means may be any suitable oscillator and transducer 34 capable of generating frequencies within that range. For example, an electromagnetic speaker coil may be used as the transducer.

According to the process of this invention, the melt 10 is maintained at a predetermined height within columnar vessel 11 to provide the required constant hydrodynamic head necessary for accurate control of the velocity of melt jet 30 as well as of the diameters of pellets 31. The velocity $v$ of the melt jet is expressed as $$v = \sqrt{2gh} \tag{1}$$

where $g$ is the acceleration due to gravity and $h$ is the height of the melt column taken from the surface of melt 10 to the level of orifice 16 as shown in FIG. 3. The diameter of the spherical pellet 31 is a function of the diameter of the orifice which in turn is a function of the "wavelength" λ of the melt globule 32 eventually pinched off for each pellet as illustrated in FIG. 4. This can best be illustrated by the following brief presentation.

The velocity $v$ of the melt jet may also be stated as $$v = f\lambda \tag{2}$$

where $f$ is the vibration frequency.

The volume V of the melt globule 32 may be defined as $$V_g = \pi \left(\frac{D_o}{2}\right)^2 \lambda \tag{3}$$

where $D_o$ is the diameter of orifice 16.

Since the volume of globule 32 becomes the volume of spherical pellet 31, the volume V of pellet 31 is $$V = \pi \left(\frac{D_o}{2}\right)^2 \lambda = \frac{4}{3}\pi \left(\frac{D_s}{2}\right)^3 \tag{4}$$

where $D_s$ is the diameter of the solid pellets.

From this, it will be seen that $$\lambda = \frac{2}{3}\frac{D_s^3}{D_o^2}. \tag{5}$$

From these relationships, it is possible to set $d_s$ and $d_o$ and determine the operational values of parameters $H$ and $f$, the control of both of which provides an accurate control over the pellet diameter. In practicing the process, it will generally be convenient to use height (hydrodynamic head) control, through the operation of valve 22, as the means for effecting gross adjustments and frequency control through transducer 34 as the means for effecting fine adjustments in the pellet diameters. Such adjustments may be made continually; and they are also available for correcting for apparatus changes such as slight increases in the orifice diameter with use and accompanying enlargement through wear.

FIG. 1 illustrates means for monitoring pellet diameter and for effecting both gross and fine adjustments. The choice of the trajectory angle $\theta$ (FIG. 3) and of the velocity $v$ of the melt jet determines the height $h_t$ of the trajectory. Any variation in $h$ will affect the magnitude of $v$ (Equation (1) and $h_t$. The relationship of $v$ to $\lambda$ and hence to the diameter of the pellets is shown by Equations (2) and (5). By monitoring $h_t$, it is therefore possible to indirectly monitor and control $h$ and hence the hydrodynamic head. In FIG. 1 this is done by providing a light source 35 positioned to direct a beam of light onto a photocell 36 which directs a signal through amplifier 37 to an electronic controller 38 capable of controlling valve 22. Light source 35 and photocell 36 are placed at a level such that when the individual pellets reach the desired, predetermined trajectory height $h_t$, the passage of the pellets within the light beam causes a partial reduction in the intensity of the light striking photocell 36. The signal from photocell 36 passing through amplifier 37 is then such as to cause controller 38 to leave valve 22 in a preset condition. However, if the height of the column drops below the predetermined level, the trajectory height will fall and the pellets 31 will fail to effect any interception of the light beam reaching photocell 36. The signal from photocell 36 will therefore be increased to its maximum value and controller 38 will respond to this change in signal intensity by opening valve 22 until the condition is reached where the column height has risen sufficiently to generate a signal of the intensity associated with the desired $h_t$. If the height of the melt column rises above the desired level, the light beam reaching photocell 36 will be periodically cut off giving rise to a periodical or chopped signal reaching controller 38. Under these conditions, controller 38 is designed to actuate valve 22 to close it to the extent that the melt flow into the melt column is decreased to the level whereby $h_t$ is returned to the desired value.

The apparatus of FIG. 1 provides also for monitoring and controlling the frequency of the vibratory motion imparted to the melt in manifold 14. As the solid pellets 31 drop through a suitable aperture 40 in housing 28 for accumulation in a storage bin 40, selected pellets are scanned by an optical sensor 42 capable of measuring the diameter of the pellets. Optical sensor 42 may be of the type capable of generating a signal which is a function of the pellet diameter and of then transmitting the signal via amplifier 43 to the oscillator and transducer 34 which is set to produce a predetermined frequency when it receives a predetermined signal. Of the signal from optical sensor 42 varies from the predetermined signal, then transducer 34 will automatically respond by making minor changes in frequency until the signal is returned to its predetermined value. This means, or other suitable means, provides for the fine adjustment of pellet diameter. In an alternative mode of operation, the optical sensor may be visually observed and the signal from it periodically manually adjusted.

Finally, the apparatus of FIG. 1 illustrates exemplary means for maintaining the melt temperature at a predetermined level. A thermocouple 45 is inserted into melt 10 and a signal from the thermocouple is transmitted by way of amplifier 46 through controller 47 which controls the level of power into heating coils 25 and 26.

FIG. 5 illustrates another embodiment of the apparatus of this invention, and in this drawing the same reference numerals are used to identify the same apparatus components of FIG. 1. In the embodiment of FIG. 5, the secondary melt supply means comprises a flared extension 50 of the column section 12 of columnar vessel 11; and the primary melt supply means comprises a tiltable ladle 51 arranges to discharge the melt at a predetermined rate into column extension 50. The means for maintaining the melt column height at the predetermined level comprises a float 52, formed for example of tantalum or a suitable ceramic, designed to rest on the surface of melt 10 and to have a vertical, upwardly extending rod member 53 suitable for engaging a linear voltage differential transformer 54. Transformer 54 is in turn connected through an amplifier 55 with a servomotor 56 having a pinion 57 mounted on its shaft and designed to engage the teeth 58 of a quadrant drive 59 attached to ladle 51 for controlling the discharge of melt therefrom into flared section 50.

Housing 65 has a bottom opening 66 positioned to allow discharge of pellets 31 into a liquid cooling bath 67 contained within a vessel 68 which is attached to housing 65 in a manner to allow liquid 67 to act as a gas trap for the gaseous atmosphere within volume 69 of housing 65. The solid pellets are carried out of cooling liquid 67 by means of an endless belt 70 engaging a pellet discharge ramp 71.

It is, of course, within the scope of this invention to interchange the melt column height control means of the two embodiments as well as to employ only column height control means or only vibration frequency control means to adjust and control the diameter of the solid pellets formed. The use of various forms of electronic signal generation means and of control means responsive to such signals will be apparent to and within the capabilities of those skilled in the art.

In the formation of iron pellets using the process and apparatus of this invention, the control of the atmosphere, e.g., volume 29 or 69 of FIG. 1 or FIG. 5, in which the pellets are formed is important. In this regard, when iron pellets are to be made for ammunition it is necessary to use an essentially nitrogen-free atmosphere, e.g., argon, to prevent the nitriding of the iron which would have an undesirable hardening affect. The control of the quality of the atmosphere may also be used to control the rate of pellet cooling and thus the size of the apparatus. Cooling of pellets 31 is effected through a combination of radiation, conduction and convection. The rate of cooling is strongly influenced by the atmosphere maintained in the space 29 or 69. The rate of cooling by convection in hydrogen is much greater than the rate of cooling by convection in air. The rate of cooling by radiation can be enhanced by maintaining an atmosphere which imparts to the pellets a surface of high emissivity. For example, it may be shown that for a melt height of 200 cm and a trajectory angle $\theta$ of 30°, the trajectory height required for cooling iron pellets to nearly complete solidification is 1171 cm in air and only 204 cm in hydrogen, using an emissivity of 0.2 for iron in hydrogen. The vertical head and height of the apparatus can be reduced still further to less than 100 cm by introducing a small quantity of water vapor with the hydrogen to produce a surface oxide layer on the iron and thereby raise its emissivity from 0.2 to about 0.9.

The following example, which is meant to be illustrative and not limiting, is given to further describe the process and apparatus of this invention. An iron melt column head of 75 cm and at 1575° C is maintained in the apparatus of FIG. 1 by the mechanism shown. A trajectory angle of 30°, a vibratory frequency of 505 Hertz and an orifice diameter of 0.169 cm results in iron pellets having a diameter of 0.319 cm.

Figure 6:
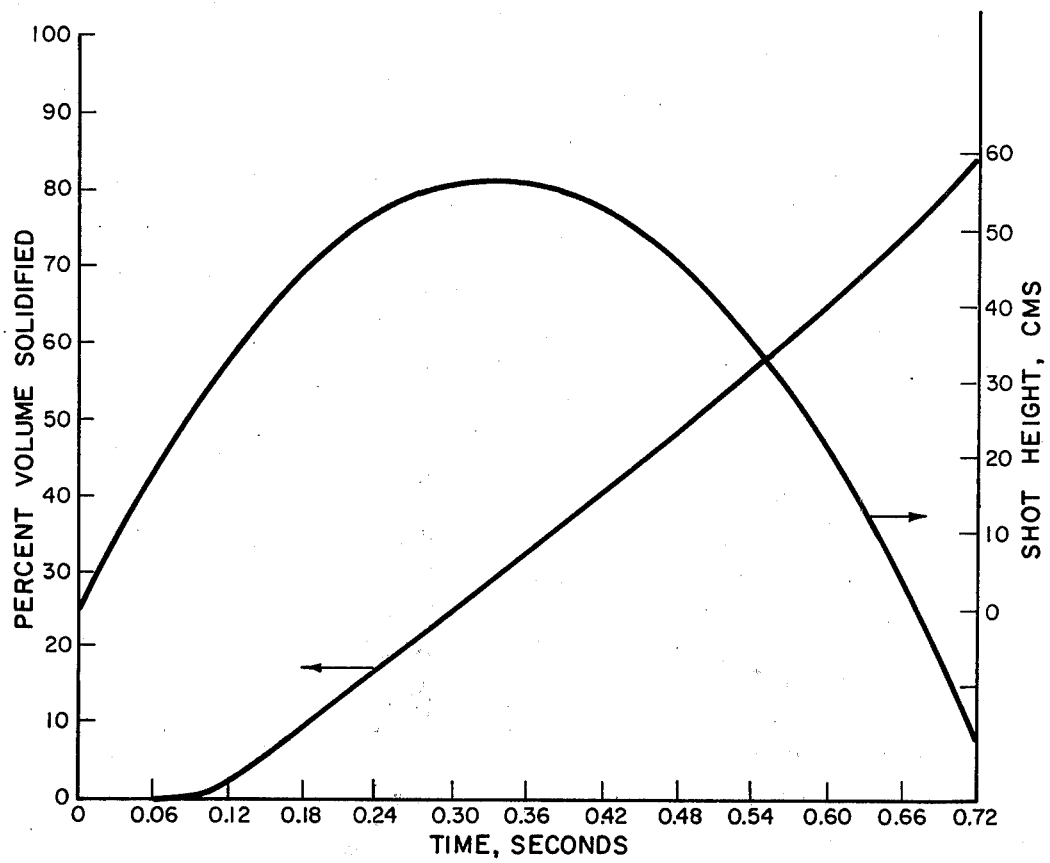
FIG. 6 is a plot of two parameters, percent volume solidified and shot height, plotted against time for an example of the process of this invention.

FIG. 6 is the pellet cooling curve and pellet trajectory pattern for this example. It will be seen that the trajectory height reaches a maximum at about 57 cm and that about 50 percent of the pellet volume is solidified after about one-half second at a point where the shot is about 40 cm above the level of the orifice. By the time the pellets have reached the bottom of the apparatus at a level about 15 cm below the orifice, some 85% of the pellet volume is solidified. Since the pellets cool from the surface inwardly, in is only necessary for the pellet to cool to a depth which enables it to retain its spherical shape before it contacts other pellets. They should, therefore, have a solid skin before accumulating. Final cooling and solidification can be accomplished and hastened, if desired, by using a cooling fluid such as an inert gas in an accumulation area or a liquid such as kerosene in the vessel 68 of FIG. 5.

Figure 7:
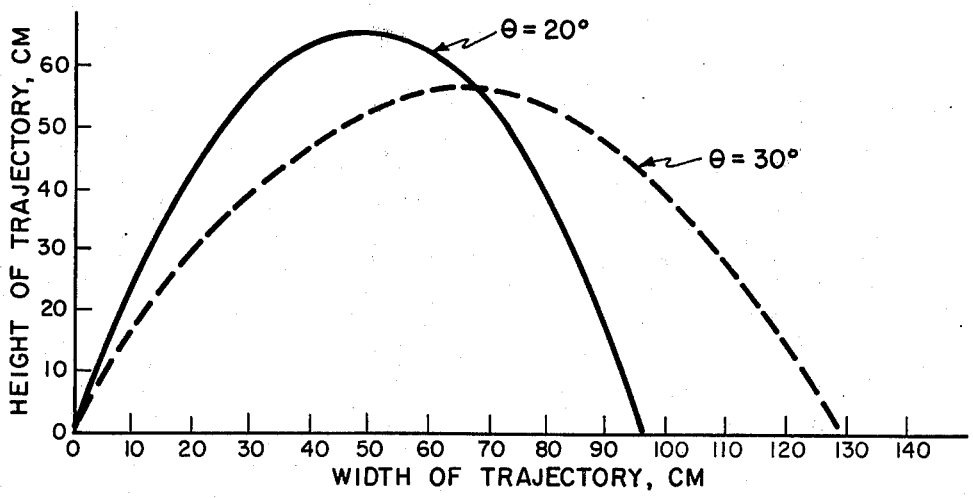
FIG. 7 is a plot of trajectory height versus horizontal trajectory width for exemplary trajectory angles.

The trajectory angle $\theta$ determines both the height and width of the trajectory and thus has a bearing on the dimensions of the apparatus. This is illustrated in FIG. 7 which is a plot of trajectory height versus width for trajectory angles of 20° and 30°, using the example given above. It will be seen that the smaller the trajectory angle $\theta$, the higher but narrower the volume (e.g., volume 29 or 69 of FIGS. 1 or 5) may be. The trajectory angle must, however, be great enough so that when the pellets reach the top of the trajectory and are travelling momentarily on a horizontal line, they are not close enough to touch. This dictates that $$\frac{v \sin \theta}{f} > D_s \tag{6}$$

and therefore that $$\sin \theta > D_s f / v, \tag{7}$$

that is that sin $\theta$ must be greater than the product of the pellet diameter and frequency divided by the jet velocity.

The maximum trajectory angle is that which is commensurate with the desired size of the apparatus. It will, of course, be less than 90° and generally it will be preferable to choose an angle which permits the use of the highest trajectory which can conveniently be tolerated within the apparatus.

The effect of using an upwardly directed trajectory may be illustrated by comparing the process of this invention with the present process which comprises dropping liquid metal from orifices oriented to direct the liquid jet downwardly. The liquid jet in this latter case emerges with an initial downward velocity and because the pellets are also accelerated by gravity, a relatively long vertical fall is required to allow sufficient time in free fall for the pellets to solidify. For example, if the hydraulic head is 200 cm and it requires 1.1 seconds of cooling to form a substantial solid skin on iron pellets, then the distance which must be travelled by the pellets in falling directly downward must be 1277 cm whereas the trajectory of a jet directed upwardly with an angle of 30° would require only 150 cm of height to achieve the same time of flight and degree of cooling.

The diameter $d_s$ of the solid pellet is a function of the diameter of the orifice and it may be expressed as $$D_s = \alpha D_o. \tag{8}$$

From the combination of equations (5) and (8) it is apparent that $$\lambda = \frac{2}{3} \alpha^2 D_s = \frac{v}{f} \tag{9}$$

and therefore $$\alpha^2 f = \frac{3}{2} \frac{v}{D_s} \tag{10}$$

It has been determined that $\alpha_o$, which is the value for this constant at the natural frequency $f_o$ of the system, has a value of 1.89. It is also known that the minimum frequency, $f_{min}$, is more than an octave below, while the maximum frequency, $f_{max}$, is about a fifth above the natural frequency. Thus, it can be shown that $$\alpha^2_{max} = \frac{\alpha^2_o f_o}{f_{min}} > 2\,\alpha^2_o \quad \text{or} \quad 2.67 \tag{11}$$

$$\alpha^2_{min} = \frac{\alpha^2_o f_o}{f_{max}} \approx \frac{2}{3}\,\alpha^2_o \quad \text{or} \quad 1.54 \tag{12}$$

This then means that the orifice size may range between 0.375 $D_s$ and 0.649 $D_s$ with the preferred value being about 0.65 $D_s$ which is equivalent to $\alpha_o = 1.89$.

It will be apparent that the use of the process and apparatus of this invention makes it possible to form essentially spherical pellets directly from a melt over a wide range of predetermined sizes, and that the variation in diameter of any predetermined size may be maintained at a minimum. This means that there is comparatively little waste in the process; and, moreover, any pellets which are rejected may be returned for remelting and repellitizing.

As noted previously, the use of iron pellets in shotgun shells or other ammunition requires that the pellets have a controlled surface hardness. The Sporting Arms and Ammunition Manufacturers Institute have, for example, specified that metal shot for shotgun shells should have a surface hardness after processing and heat treatment to meet the following requirements: a Diamond Pyramid Hardness (10 kg load) of 65 or a Knoop Hardness (500 g) of 76. In forming iron pellets by the process of this invention, this may be achieved by controlling the carbon content of the melt, in which case the entire pellet meets this requirement; or it may be achieved by reducing the carbon content of the pellet surface after it is formed. Techniques for accomplishing either of these modifications of carbon content control are known in the art.

Examples of a technique for reducing the carbon content of the melt used in forming the pellets is the addition of iron oxide, $Fe_2O_3$ or $Fe_3O_4$, to the melt to react with a portion of the carbon and remove it as carbon monoxide and carbon dioxide. This was, before oxygen lancing, a standard procedure used in open hearth operation and it is therefore well known.

The reduction of the carbon content of the surface of the iron pellets may also be done by well known techniques involving the control of pellet temperature and the atmosphere surrounding the pellets. For example, elevated temperatures and atmospheres containing either a suitable mixture of carbon monoxide and carbon dioxide, hydrogen, or water vapor can be used to reduce the carbon content of the pellet surface to a predetermined level and depth.

This invention therefore contemplates the optional use of a molten iron having a carbon content at or below that level required to form pellets with a Diamond Pyramid Hardness (10 kg load) no greater than about 65; or the incorporation of the additional step of reducing the carbon content of the iron pellets formed to or below the specified hardness level.

This invention provides commercially economically apparatus for forming essentially spherical pellets directly from a melt, and it is particularly suited to the manufacture of iron pellets which can be used in place of lead pellets in shotgun shells and other types of small arms ammunition.

It will thus be seen that the objects set forth above, among those made apparent from the preceding description, are efficiently attained and, since certain changes may be made in carrying out the above process and in the constructions set forth without departing from the scope of the invention, it is intended that all matter contained in the above description or shown in the accompanying drawings shall be interpreted as illustrative and not in a limiting sense.

We claim:

1. A process for forming solid pellets of essentially spherical configuration from a melt, comprising the steps of
   a. providing a column of predetermined height of a melt of a material to be formed into solid spherical pellets;
   b. continuously maintaining said melt column at said predetermined height;
   c. directing said melt through at least one orifice at the bottom of said melt column to form a melt jet having an upwardly directed trajectory, while
   d. isolating said melt jet from acoustical and hydrodynamic disturbances induced in the maintaining of said predetermined height; and
   e. during the forming of said melt jet, imparting a vibratory motion to the bottom of said melt column, whereby said melt jet breaks up to form essentially spherical pellets continuing said trajectory, the total length of said trajectory being such that at least the outer skins of said pellets are solidified prior to their accumulation at the end of their trajectory travel.

2. A process in accordance with claim 1 wherein said step of continuously maintaining said melt column at said predetermined height comprises sensing the height of said melt column thereby to develop a signal which is a function of said height and employing said signal to control the introduction of melt into said melt column at a rate to maintain said predetermined height.

3. A process in accordance with claim 1 wherein said step of continuously maintaining said melt column at said predetermined height comprises sensing the height of said pellets as they reach their maximum height in said trajectory thereby to develop a signal which is a function of said trajectory height and employing said signal to control the introduction of melt into said melt column at a rate to maintain said predetermined height.

4. A process in accordance with claim 1 wherein said step of isolating said melt jet from said acoustical and hydrodynamic disturbances comprises providing damping bodies in said melt column and directing the resulting damped melt into a manifold serving as said bottom of said melt column and with which said at least one orifice communicates.

5. A process in accordance with claim 4 wherein said melt is directed through a plurality of orifices to form a plurality of said melt jets having separate upwardly directed trajectories.

6. A process in accordance with claim 4 wherein said step of imparting a vibratory motion to the bottom of said melt column comprises driving said manifold at a frequency ranging between about 5 Hz and about 50 kHz.

7. A process in accordance with claim 1 including the step of sensing the diameter of selected of said pellets thereby to develop a signal which is a function of said diameter and employing said signal to control the frequency at which said vibratory motion is imparted to the bottom of said melt column.

8. A process in accordance with claim 1 including the step of providing a source of heat to maintain said melt column at a predetermined temperature.

9. A process in accordance with claim 8 including the step of sensing the temperature of said melt thereby to develop a signal and using said signal to control the amount of heat delivered by said source of heat.

10. A process in accordance with claim 1 including the step of thermally insulating said melt column.

11. A process in accordance with claim 1 including the step of controlling the atmosphere around at least said melt jet and trajectory.

12. A process in accordance with claim 11 wherein said step of controlling said atmosphere comprises providing an atmosphere which increases the rate of cooling of said pellets through the mechanism of convection, radiation or both.

13. A process in accordance with claim 1 including the step of directing said pellets at said end of their trajectory travel into a cooling fluid.

14. A process in accordance with claim 1 wherein said melt is iron.

15. A process in accordance with claim 13 including the step of providing an essentially nitrogen-free atmosphere around at least said melt jet and said pellets in their trajectory travel.

16. A process in accordance with claim 15 wherein said nitrogen-free atmosphere includes hydrogen to increase the rate of cooling of the resulting iron pellets through convection.

17. A process in accordance with claim 16 wherein said nitrogen-free atmosphere also includes sufficient water vapor to produce a surface oxide layer on said iron pellets thereby to increase the emissivity of the surface of said iron pellets.

18. A process in accordance with claim 14 including the step of decarburizing said melt to a sufficient extent to produce iron pellets with a Diamond Pyramid Hardness (10 kg load) no greater than about 65.

19. A process in accordance with claim 14 including the step of decarburizing at least the surfaces of the resulting iron pellets so that they have a Diamond Pyramid Hardness (10 kg load) no greater than about 65.

20. An apparatus for forming solid pellets directly from a melt, comprising in combination a. a columnar vessel for containing a melt, having a columnar section and terminating at its lower end in manifold means having an orifice plate slanted such that the normal to said orifice plate forms an acute angle with the vertical;

b. at least one orifice in said orifice plate arranged to impart an upwardly directed trajectory to a jet of said melt directed therethrough from said vessel;

c. means to impart vibratory motion to said lower end of said columnar vessel whereby individual pellets are formed from said jet to continue in said trajectory;

d. means to maintain the level of said melt within said columnar vessel at an essentially constant predetermined level;

e. means to isolate said melt jet from acoustically and hydrodynamically induced disturbances in said columnar section of said columnar vessel; and f. heating means to maintain said melt at an essentially constant predetermined temperature.

21. An apparatus in accordance with claim 20 wherein said orifice plate has a plurality of orifices.

22. An apparatus in accordance with claim 21 wherein said orifices are circular in cross section.

23. An apparatus in accordance with claim 20 wherein said means to impart vibratory motion to said lower end of said columnar vessel transducer and oscillator means arranged to drive said manifold means.

24. An apparatus in accordance with claim 23 wherein said transducer and oscillator means drive said manifold means at a frequency ranging between about 5 Hz and 50 kHz.

25. An apparatus in accordance with claim 20 wherein said means to maintain said level of said melt within said columnar vessel comprises means to sense the maximum height of said trajectory, means to generate a signal which is a function of said height of said trajectory, and means, responsive to said signal, to control the amount of said melt added to said columnar vessel thereby to maintain said melt level.

26. An apparatus in accordance with claim 25 including a secondary melt vessel joined through fluid communication means with said columnar vessel and said means to control the amount of said melt added to said columnar vessel comprises valve means in said fluid communication means.

27. An apparatus in accordance with claim 20 wherein said means to maintain said level of said melt within said columnar vessel comprises means to sense said melt level, means to generate a signal which is a function of said melt level, and means, responsive to said signal, to control the amount of said melt added to said columnar vessel thereby to maintain said melt level.

28. An apparatus in accordance with claim 20 wherein said columnar vessel has a foraminous members dividing said columnar section from said manifold means, and said means to isolate said melt jet comprises damping bodies within said columnar section.

29. An apparatus in accordance with claim 20 wherein said heating means comprises electrical resistance heater means surrounding said columnar vessel, means to sense the temperature of said melt and generate a signal, and means, responsive to said signal, for controlling electrical power to said electrical resistance heater means.

30. An apparatus in accordance with claim 20 including thermal insulation means surrounding said columnar vessel means and said heating means.

31. An apparatus in accordance with claim 20 including secondary melt supply means arranged to provide melt to said columnar vessel; and means, controlled by said means to maintain the level of said melt within said columnar vessel, for transferring melt from said secondary melt supply means to said columnar vessel.

32. An apparatus in accordance with claim 20 including housing means defining a chamber in which said melt jet and said pellets travel in said trajectory.

33. An apparatus in accordance with claim 32 including means to control the atmosphere within said chamber.

34. An apparatus in accordance with claim 32 wherein said chamber also contains said columnar vessel.

35. An apparatus in accordance with claim 20 including means to collect and withdraw said pellets.

36. An apparatus in accordance with claim 35 wherein said means to collect and withdraw said pellets includes means to contact said pellets with a liquid suitable for accelerating the rate at which their solidification is effected.

* * * * *

UNITED STATES PATENT OFFICE

CERTIFICATE OF CORRECTION

Patent No. 4,035,116 Dated July 12, 1977

Inventor(s) John L. O'Brien et al

It is certified that error appears in the above-identified patent and that said Letters Patent are hereby corrected as shown below:

Column 11, line 36, after "vessel" insert --comprises--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*